US011905725B1

(12) United States Patent
Bishop

(10) Patent No.: US 11,905,725 B1
(45) Date of Patent: Feb. 20, 2024

(54) CONNECTOR

(71) Applicant: Ameristar Perimeter Security USA Inc., Tulsa, OK (US)

(72) Inventor: Michael L. Bishop, Bristow, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 32 days.

(21) Appl. No.: 17/569,741

(22) Filed: Jan. 6, 2022

(51) Int. Cl.
*E04H 17/16* (2006.01)

(52) U.S. Cl.
CPC ..... *E04H 17/17* (2021.01); *E04H 17/163* (2013.01)

(58) Field of Classification Search
CPC ..... E04H 17/163; E04H 17/17; E04H 17/24; E04H 17/161; E04F 11/1855; E04F 2011/1823; E04F 2011/1831; E04G 2011/1823; E04G 2011/1831; F16B 5/0266; F16B 5/12; F16B 5/0685; F16B 5/0692; F16B 21/02; F16B 21/04; F16B 7/0433; F16B 7/044; F16B 7/0493
See application file for complete search history.

(56) References Cited

U.S. PATENT DOCUMENTS 4,669,936 A * 6/1987 Camilleri ..... F16B 19/1081 248/250
4,722,648 A * 2/1988 Camilleri ..... F16B 19/1081 248/250
5,746,040 A * 5/1998 Young ..... E04H 17/16 52/285.3
6,367,216 B1 * 4/2002 Maylon ..... E04F 13/042 52/363
7,360,746 B2 * 4/2008 Routhier ..... F16B 5/0685 248/250
7,740,233 B1 * 6/2010 Larsen ..... E04H 17/161 256/45
8,387,955 B2 * 3/2013 Ptacek ..... E04H 17/17 256/73
8,636,266 B2 * 1/2014 Gill ..... E04F 11/1855 256/DIG. 6
8,677,727 B2 * 3/2014 Robins ..... F16G 15/06 403/325
8,925,903 B2 * 1/2015 Gill ..... E04F 11/1855 24/458
(Continued)

FOREIGN PATENT DOCUMENTS

EP 1712710 A1 * 10/2006 ..... E04H 17/161
GB 2167488 A * 5/1986 ..... E04G 7/28
(Continued)

*Primary Examiner* — Matthew R McMahon
(74) *Attorney, Agent, or Firm* — Gary Peterson

(57) ABSTRACT

A connector is formed from a hollow barrel, an elongate pin and a hook. A pair of parallel channels are formed in one end of the barrel. The pin has an enlarged head and an attached shaft that extends through both the barrel and the base of the hook. The pin and the hook rotate as a unit. Such rotation causes the head of the pin to either block or open the channels. Two parallel strands of a sheet of infill material are received in the channels while open, and the pin rotated until the head blocks the channels, thereby capturing the strands. This rotation concurrently brings a concave portion of the hook into a position aligned with and facing a nearby post. A nut is tightened on the end of the shaft in order to firmly join the connector, sheet and post.

13 Claims, 13 Drawing Sheets

(56) References Cited

U.S. PATENT DOCUMENTS

| | | | | |
|---|---|---|---|---|
| 9,617,771 | B2 * | 4/2017 | Gill | E04G 5/145 |
| 9,788,667 | B2 * | 10/2017 | Williams | F16B 2/065 |
| 10,787,838 | B2 * | 9/2020 | Larsen | E04H 17/1426 |
| 2008/0189920 | A1 * | 8/2008 | Toombs | F16B 2/12 24/604 |
| 2010/0123113 | A1 * | 5/2010 | Young | E04H 17/161 256/47 |
| 2014/0318891 | A1 * | 10/2014 | Crothers | E04G 5/14 182/113 |
| 2022/0259888 | A1 * | 8/2022 | Stucchi | E04H 17/124 |

FOREIGN PATENT DOCUMENTS

| | | | | |
|---|---|---|---|---|
| GB | 2571771 | A | | 9/2019 |
| GB | 2601237 | A | | 5/2022 |
| JP | 2008208523 | A | * | 9/2008 |

* cited by examiner

CONNECTOR

SUMMARY OF THE INVENTION

A connector is formed from a barrel, a pin and a hook. The barrel is hollow, and has a pair of parallel channels that traverse one of its ends. The pin, which is rotatable between unactuated and actuated positions, is formed from an elongate shaft and an enlarged head. The shaft has opposed first and second ends, and extends through the barrel. The head is formed adjacent the first end of the shaft, and is configured to block the channels in the actuated position, and to clear the channels in the unactuated position. The hook engages the shaft adjacent the shaft's second end.

BRIEF DESCRIPTION OF THE DRAWINGS

FIG. 6 is a side elevation view of the barrel shown in FIG. 5, taken along line 6-6.

FIG. 19 is a front elevation view of a barrier incorporating plural connectors like those shown in FIG. 1.

DETAILED DESCRIPTION

Figure 1:
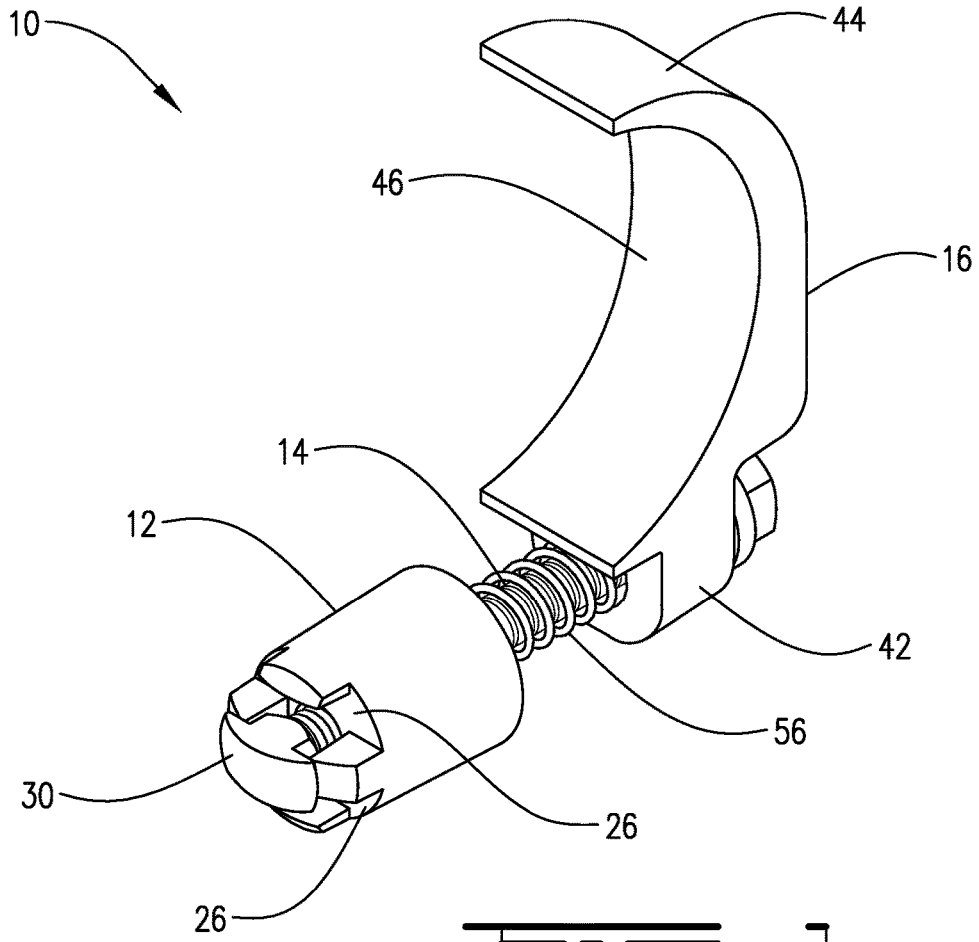
FIG. 1 is a perspective view of a connector with its pin in an unactuated position.
Figure 2:
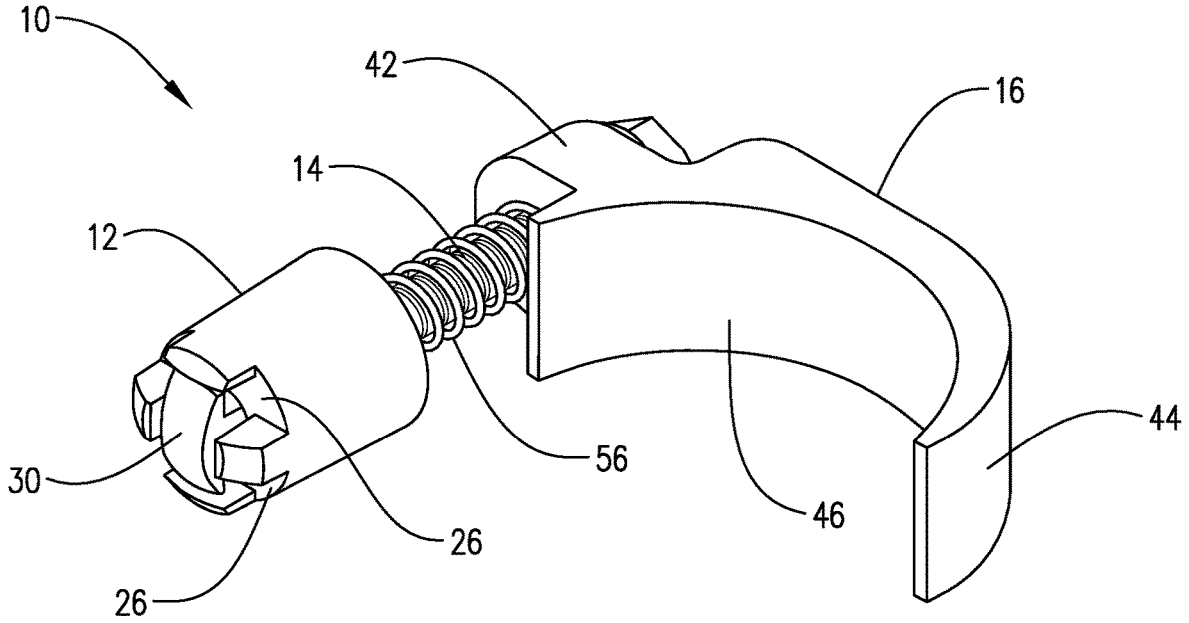
FIG. 2 is a perspective view of the connector shown in FIG. 1, with its pin in an actuated position.
Figure 3:
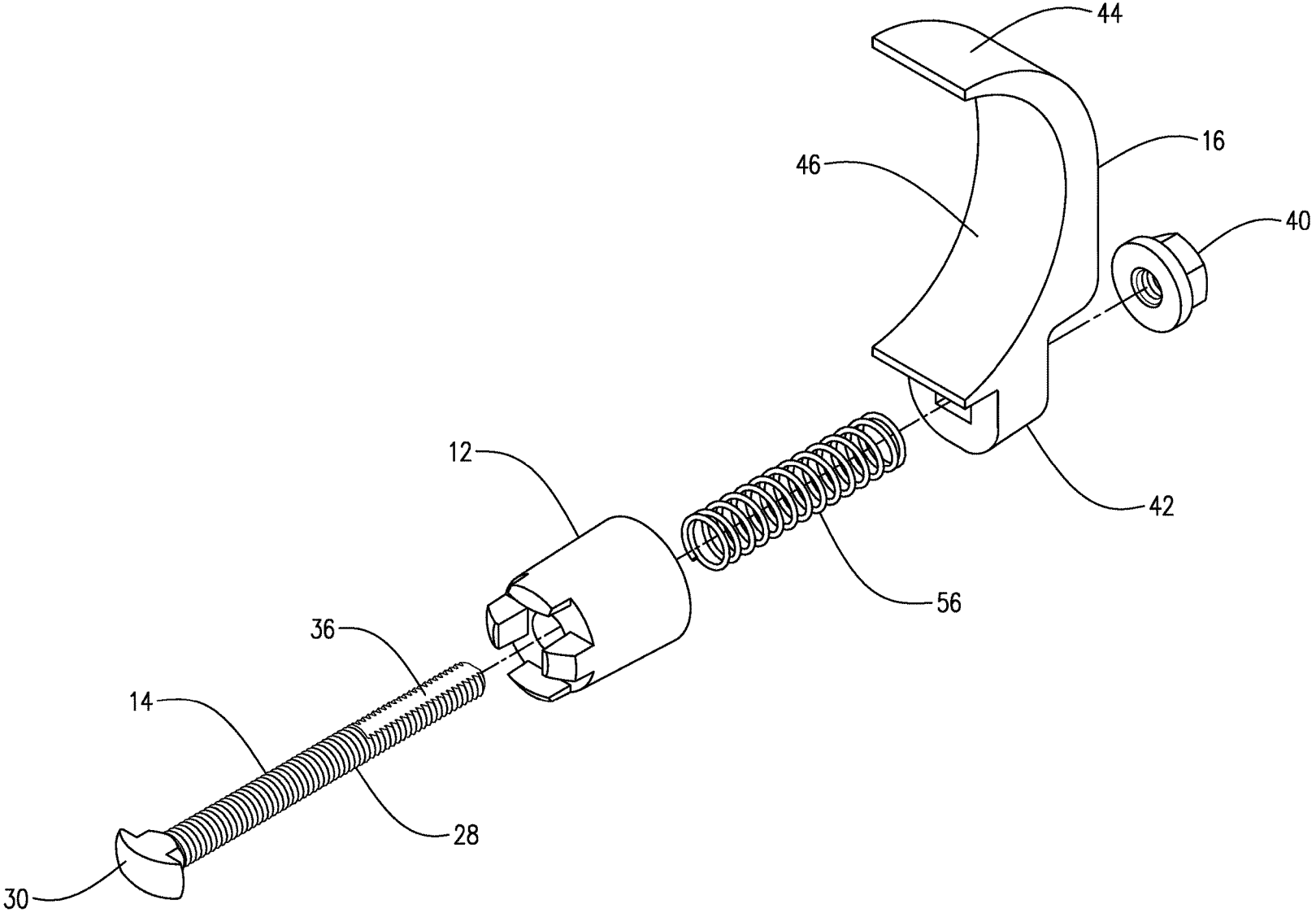
FIG. 3 is an exploded view of the connector shown in FIG. 1.
Figure 4:
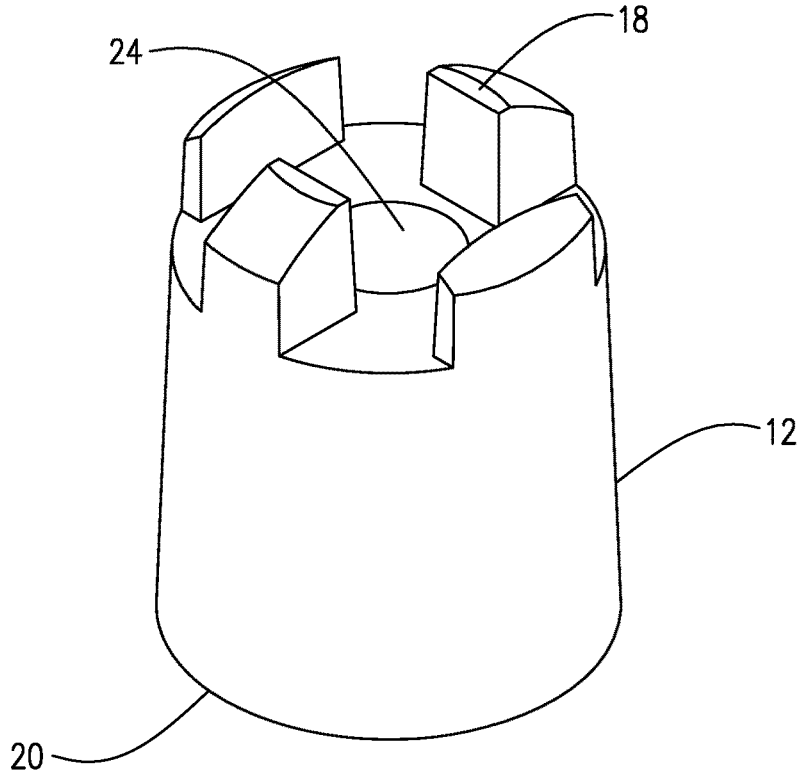
FIG. 4 is a perspective view of the barrel of the connector shown in FIG. 1.
Figure 5:
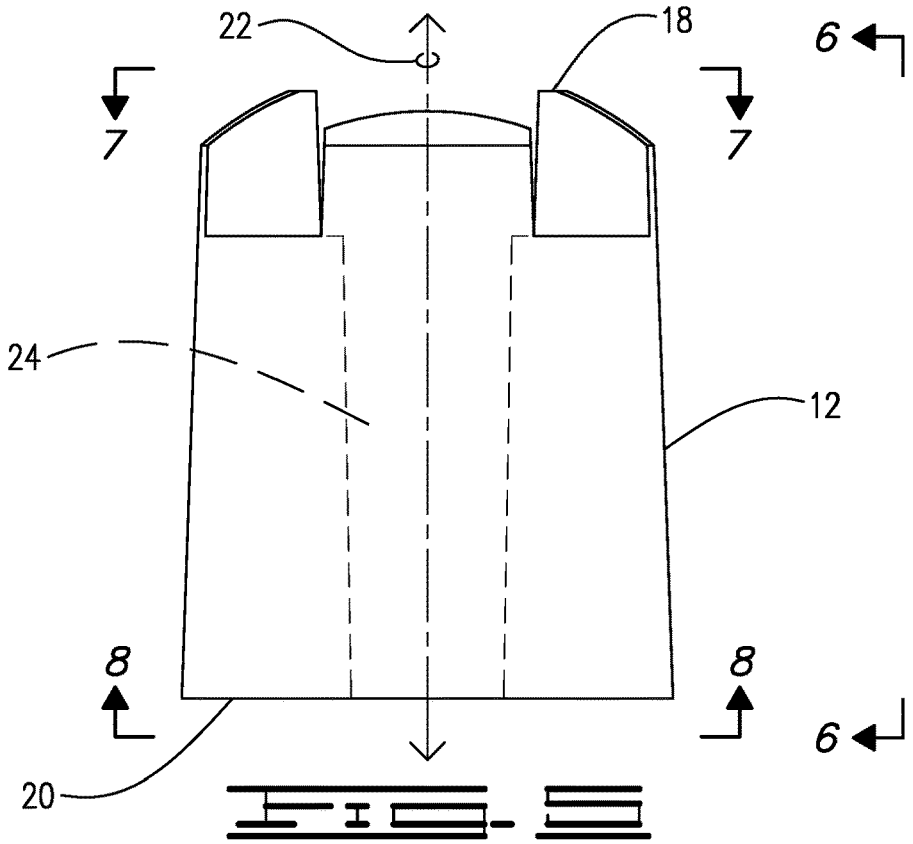
FIG. 5 is a front elevation view of the barrel shown in FIG. 4
Figure 8:
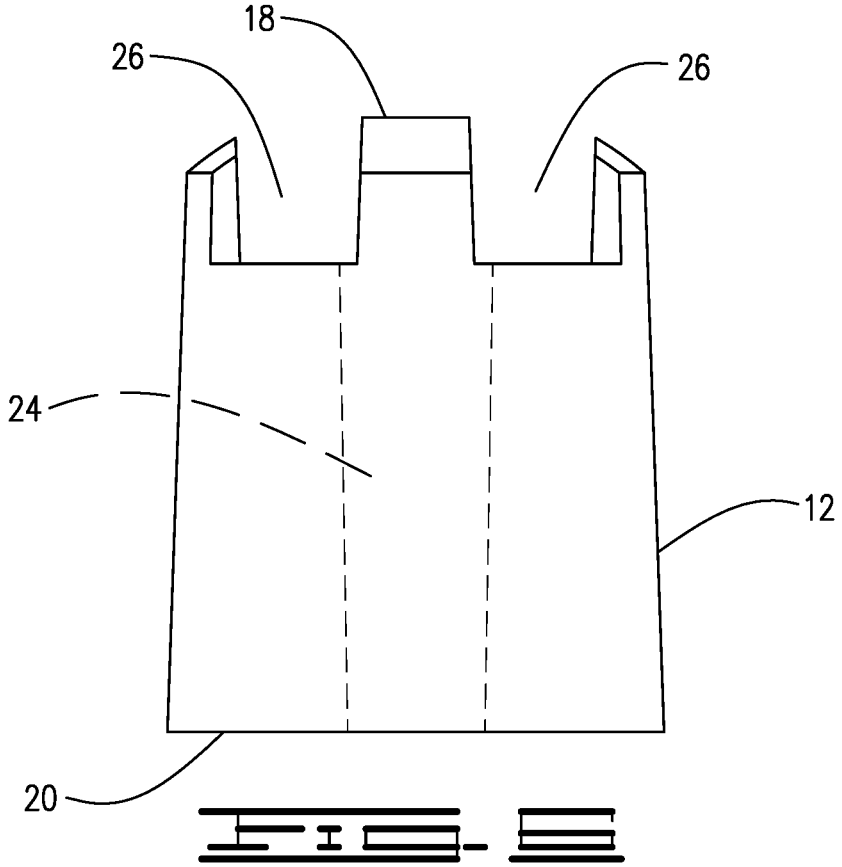
FIG. 8 is a bottom plan view of the barrel shown in FIG. 5, taken along line 8-8.
Figure 7:
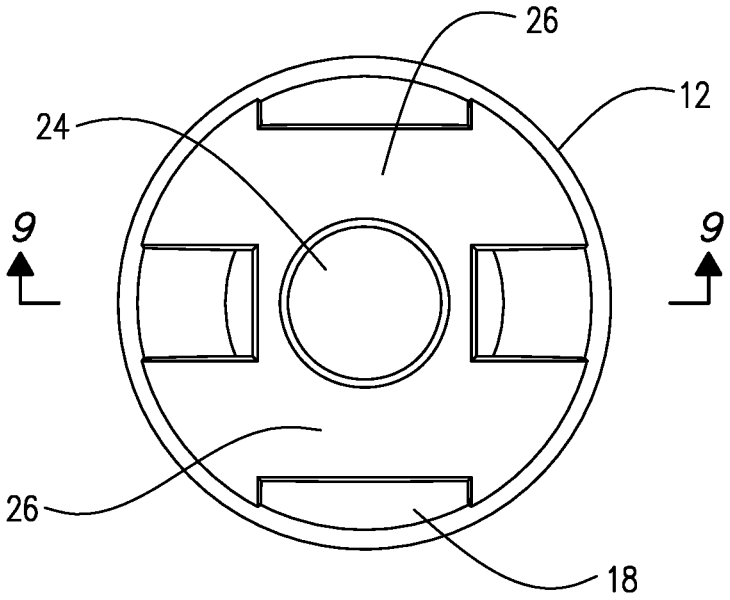
FIG. 7 is a top plan view of the barrel shown in FIG. 5, taken along line 7-7.
Figure 8:
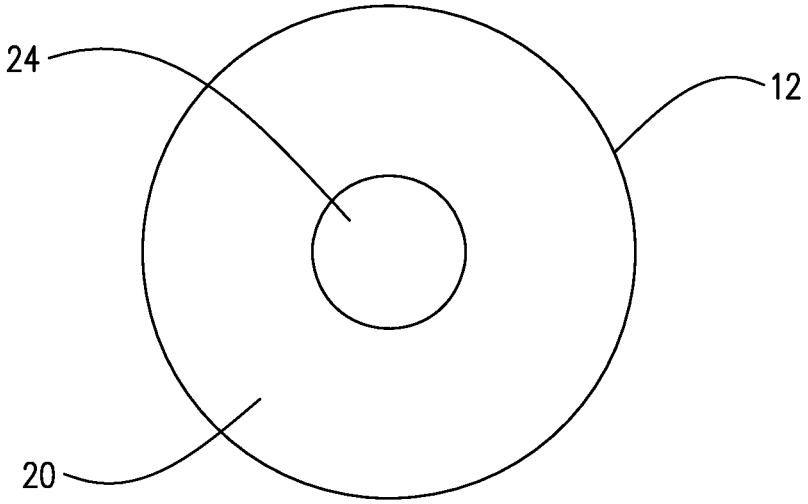
Figure 9:
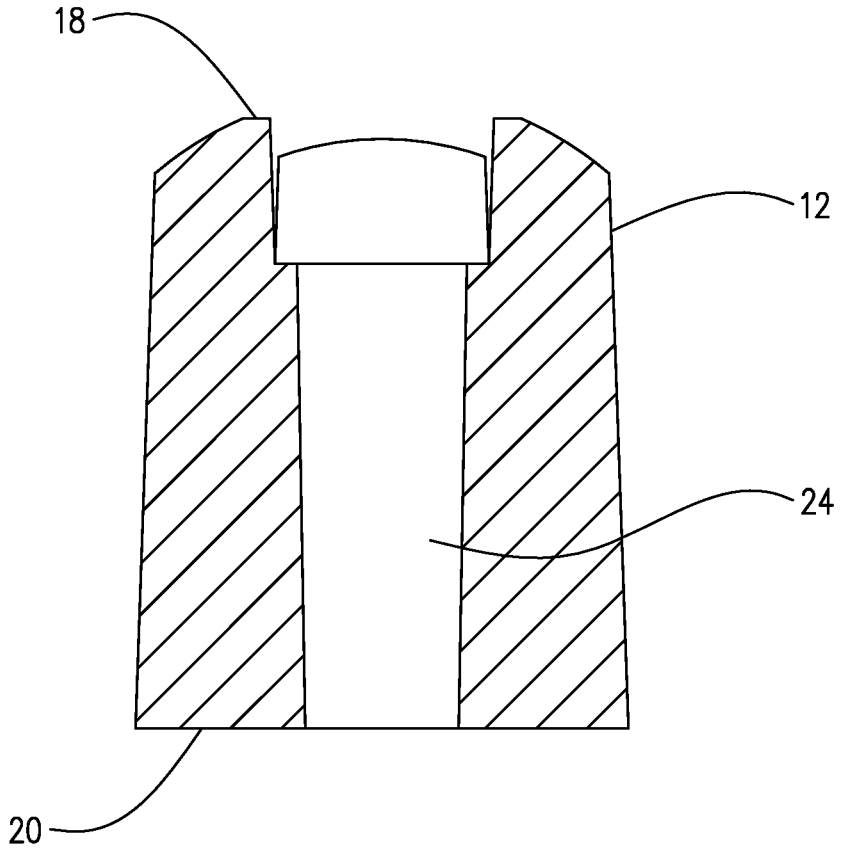
FIG. 9 is a cross-sectional view of the barrel shown in FIG. 7, taken along line 9-9.
Figure 10:
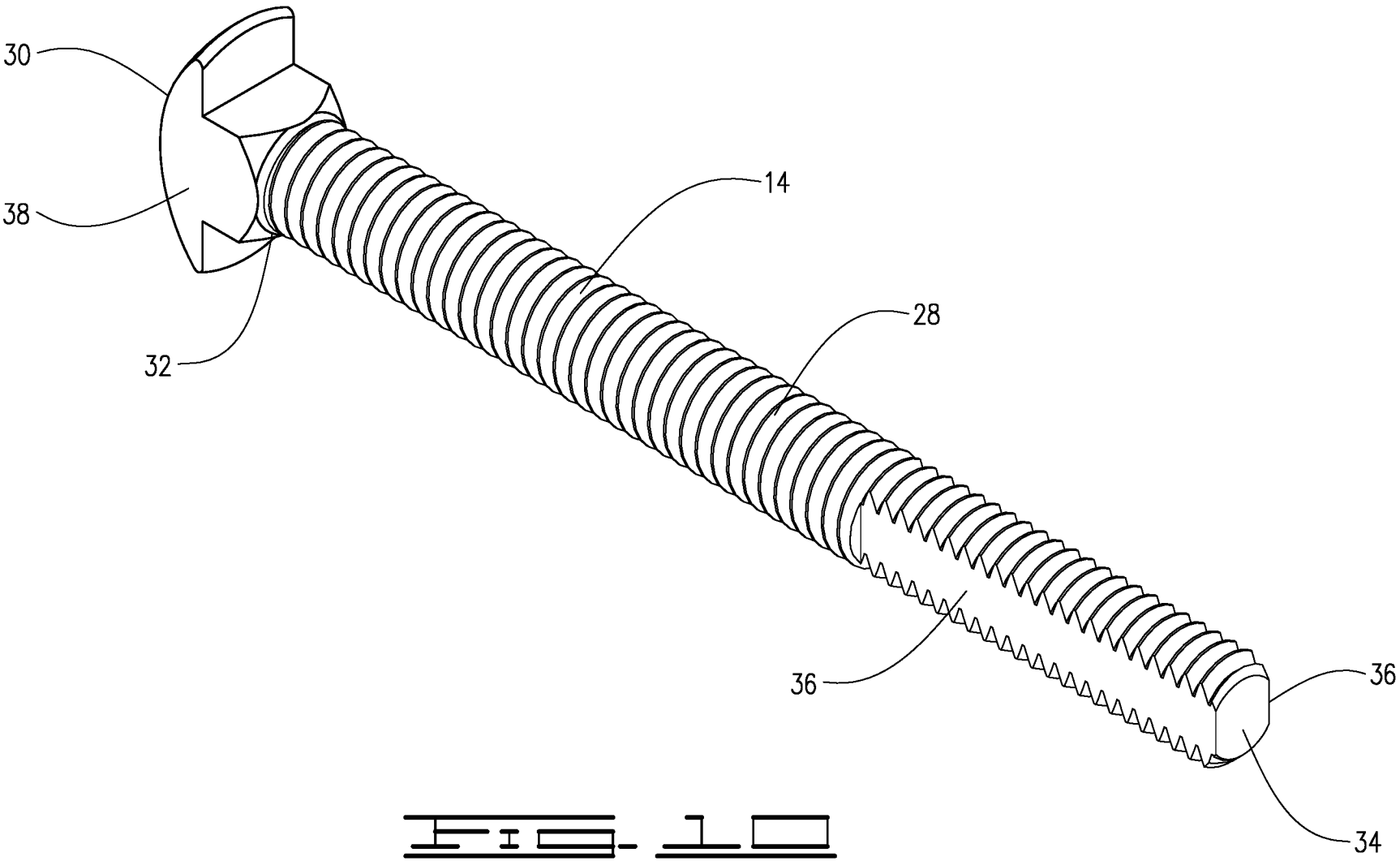
FIG. 10 is a perspective view of the pin of the connector shown in FIG. 1.
Figure 11:
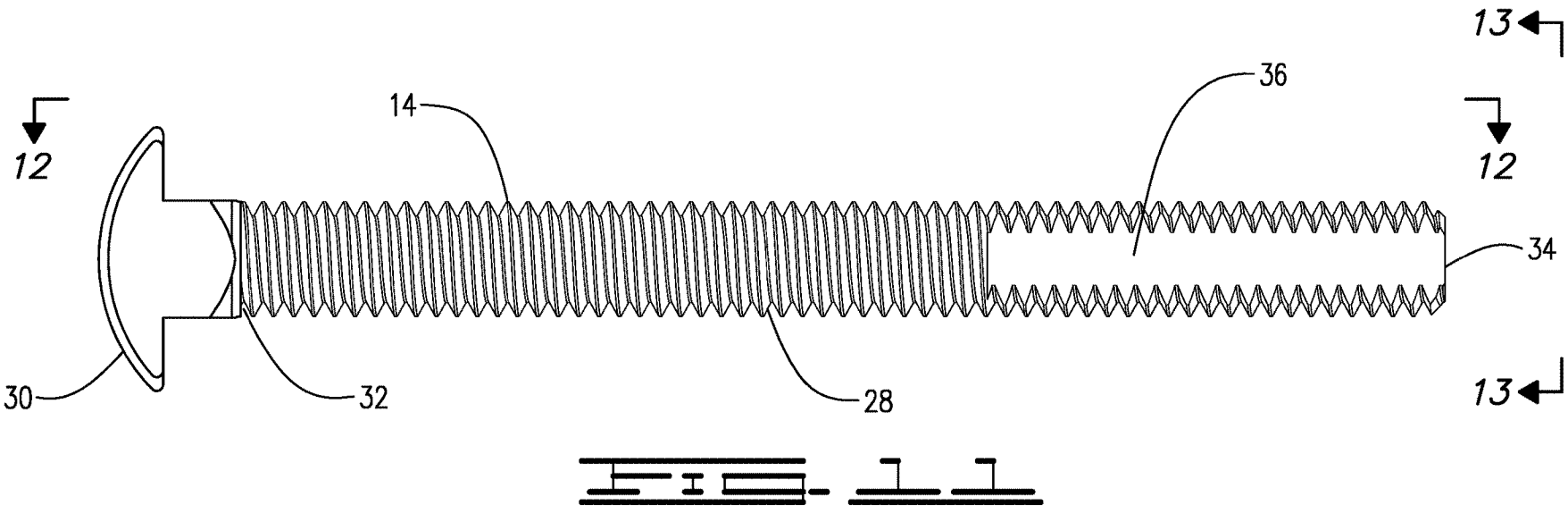
FIG. 11 is a front elevation view of the pin shown in FIG. 10.
Figure 12:
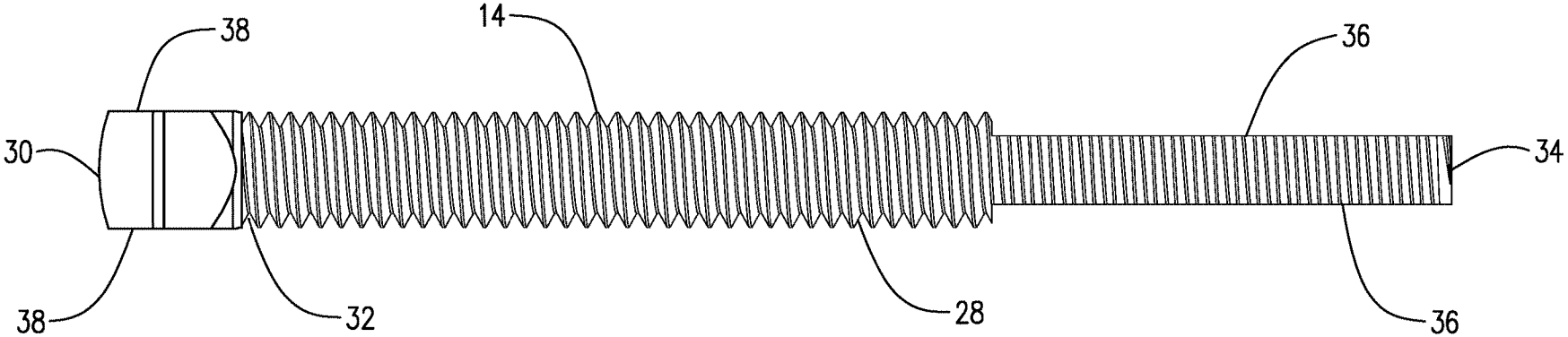
FIG. 12 is a top plan view of the pin shown in FIG. 11, taken along line 12-12.
Figure 13:
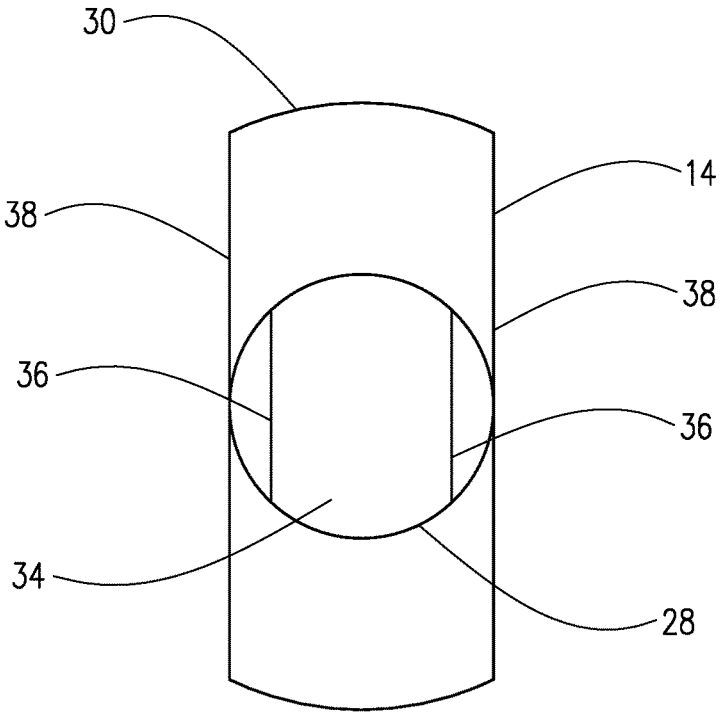
FIG. 13 is an end view of the pin shown in FIG. 11, taken along line 13-13.

A connector 10, shown in FIGS. 1-3, is formed from a barrel 12, a pin 14 and a hook 16. The barrel 12, illustrated in greater detail in FIGS. 4-9, is an elongate hollow structure having a first end 18, an opposed second end 20 and a longitudinal axis 22. Intermediate the ends 18 and 20, the barrel 12 has a curved external shape, such as that of a right cylinder or a right cone. In one embodiment, the barrel 12 has the external shape of a right conical frustum.

An elongate internal bore 24, which is preferably symmetric about the axis 22, joins the first and second ends 18 and 20 of the barrel 12. The walls of the bore 24 are preferably smooth and unthreaded. At one of the ends, which is preferably the first end 18, the barrel 12 is characterized by a castellated shape that includes a pair of parallel channels 26 that traverse the end. The channels 26 extend in normal relationship to the axis 22. The end of the barrel 12 opposite the channels 26, which is preferably the second end 20, is flat and preferably has a circular external profile.

In one embodiment, the barrel 12 has the shape of a right conical frustum and has a height of 1.31 inches. At its second end 20, the barrel 12 has a diameter of 1.06 inches. The parallel channels 26 formed at the first end 18 have a center-to-center separation of 0.5 inches, and each channel 26 is 0.25 inches wide. The distance from the base of each channel 26 to the second end 20 is 1.00 inches. At the second end 20, the bore 24 has a diameter of 0.33 inches.

As shown in FIGS. 10-13, the pin 14 comprises an elongate shaft 28 and an enlarged head 30. The pin 14 is rotatable between an unactuated position, shown in FIG. 1, and an actuated position, shown in FIG. 2.

The shaft 28 is a rectilinear structure with a first end 32 and an opposed second end 34, and is sized to extend within the bore 24 and through the barrel 12. The shaft 28 preferably has at least one laterally-disposed flat surface 36 that extends intermediate the ends 32 and 34. More preferably, the shaft 28 has two spaced and parallel flat surfaces 36, as shown in the Figures. Each flat surface 36 preferably terminates at the second end 34. Except at any flat surface 36, the shaft 28 may be externally threaded along its length.

The head 30 joins the shaft 28 adjacent its first end 32. Preferably, the shaft 28 and head 30 are formed as a single piece. The head 30 is generally wedge-shaped, and is bounded by a pair of spaced and parallel sides 38. By rotating pin 14 while the shaft 28 extends through the barrel 12, the head 30 can either block or clear the channels 26. When the pin 14 is in its actuated position, the head 30 blocks the channels 26, as shown in FIG. 2. When the pin 14 is in its unactuated position, the head 30 clears the channels 26, as shown in FIG. 1.

The pin 14 preferably further comprises a nut 40 configured for attachment to the shaft 28 at its second end 34. Preferably, the nut 40 includes internal threads that match the external threads on the shaft 28.

In the same embodiment described with reference to the barrel 12, the pin 14 is formed from a Xylan-coated 5/16-18 carriage bolt that has been modified to the configuration described above. The shaft 28 has a length of 3.5 inches. The parallel sides 38 of the head 30 are separated by 0.32 inches. There are two parallel flat surfaces 36, which are separated by 0.19 inches. Each of the flat surfaces 36 extends from the second end 34 for 1.25 inches. The nut 40 is preferably a 5/16-18 flange nut.

Figure 14:
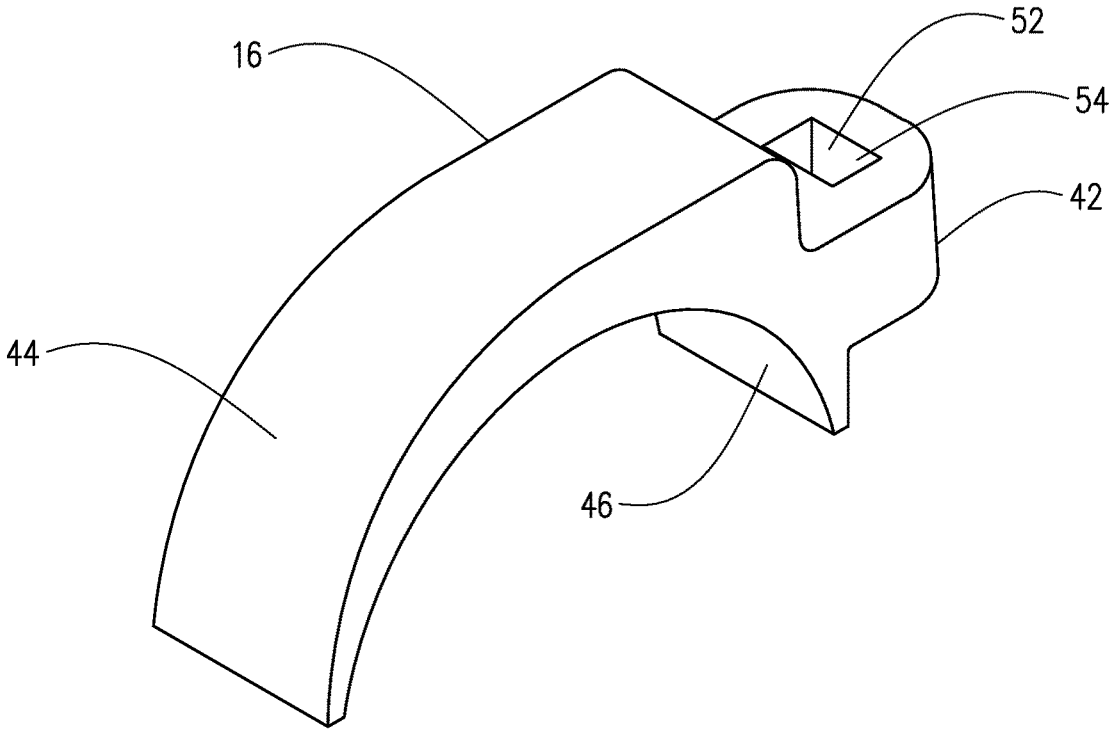
FIG. 14 is a perspective view of the hook of the connector shown in FIG. 1.
Figure 15:
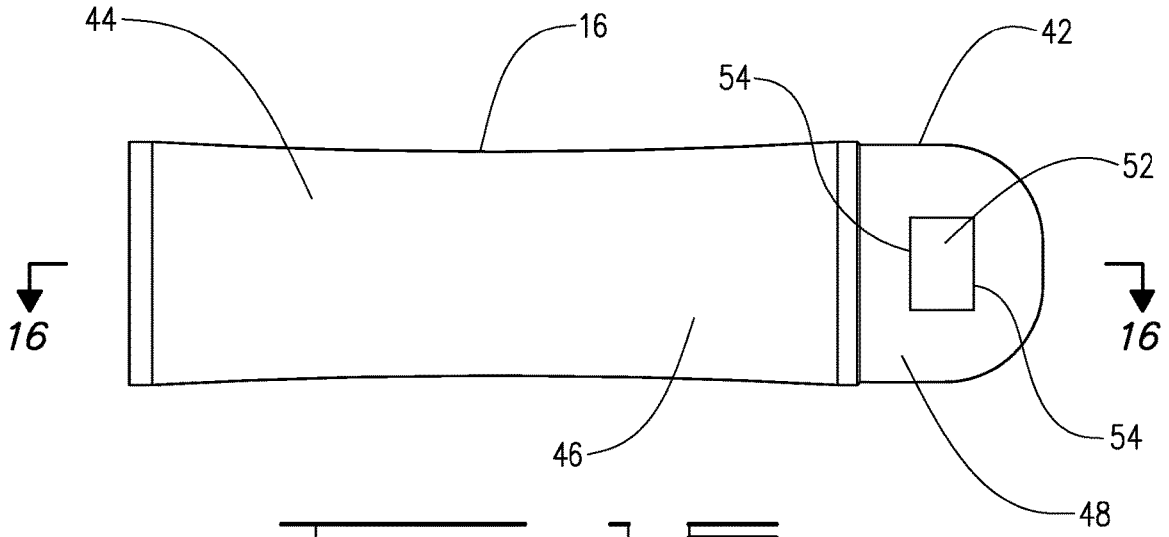
FIG. 15 is a front elevation view of the hook shown in FIG. 1.
Figure 16:
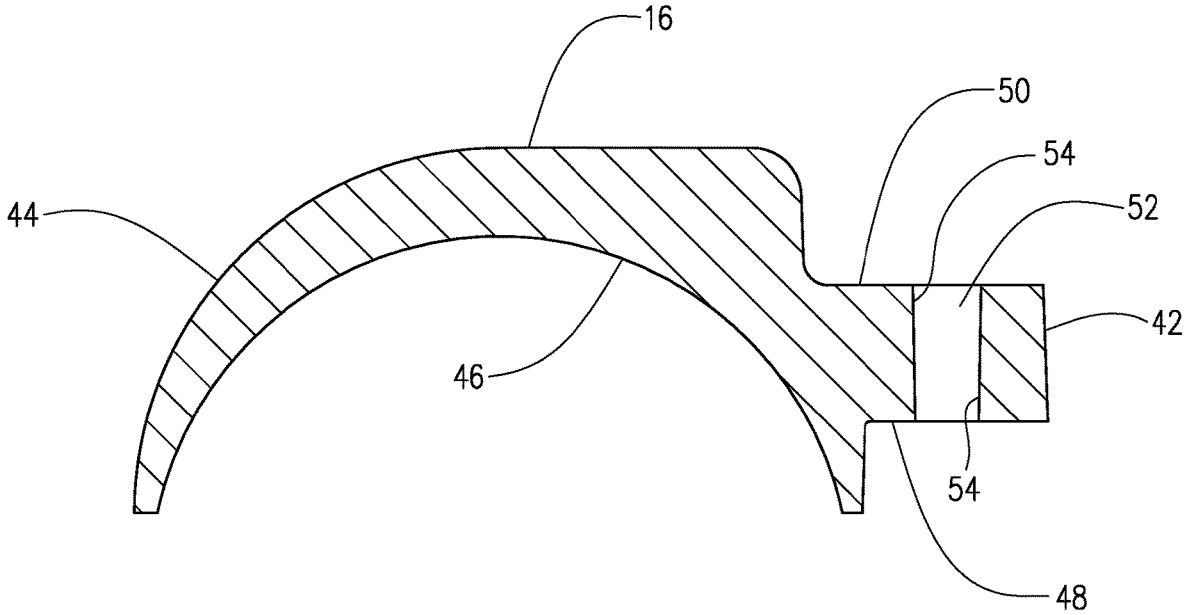
FIG. 16 is a cross-sectional view of the hook shown in FIG. 15, taken along line 16-16.

The hook 16, shown in FIGS. 14-16, comprises a base 42, which supports a body 44. The body 44 has a concavity 46, preferably arcuate in shape, formed therein. The base 42 has a first side 48, situated nearest the concavity 46, and a spaced and opposed second side 50. The sides 48 and 50 are preferably flat. A passageway 52, which is preferably rectilinear, extends through the base 42, and joins the opposed first and second sides 48 and 50.

The passageway 52 should be shaped and sized to closely but clearingly receive the shaft 28 therethrough. Preferably, the passageway 52 has a polygonal, and more preferably a rectangular, cross-sectional shape. Also preferably, the passageway 52 includes two flat, parallel and opposed walls 54 that are shaped and sized to conform to the parallel flat surfaces 36 of the shaft 28. The separation distance between the walls 54 should be slightly greater than the separation distance between the flat surfaces 36.

When the shaft 28 extends through the passageway 52, the opposed flat surfaces 38 of the shaft 28 engage the matching opposed flat walls 54. As a result, relative rotation between the shaft 28 and the hook 16 is not possible. Instead, the pin 14 and hook 16 rotate as a unit.

In the same embodiment described with reference to the barrel 12 and pin 14, the hook 16 has an overall length of 3.75 inches, an overall width of 1.0 inches, and a maximum thickness of 1.0 inches. The concavity 46 has the shape of a circular arc forming a near-semicircle. The radius of the arc is 1.44 inches. The passageway 52 has the cross-sectional shape of a rectangle having a major side of 0.38 inches and a minor side (corresponding to the separation distance between the walls 54) of 0.26 inches.

The connector 10 preferably further comprises a coiled spring 56, best shown in FIG. 3. The spring 56 is sized and shaped such that it can axially receive the shaft 28, and be interposed between the barrel 12 and the hook 16. More particularly, the spring 56 should be sized to be receivable, in a compressed state, between the second end 20 of the barrel 12 and the second side 50 of the base 42 of the hook 16. The spring 56 should have cross-sectional dimensions that exceed those of the bore 24 and passageway 52.

In the same embodiment described with reference to the barrel 12, pin 14 and hook 16, the spring 56 has an uncompressed length of 2.0 inches, an outside diameter of 0.48 inches, and a wire diameter of 0.041 inches.

The connector 10 is prepared for installation by inserting the second end 34 of the shaft 28 into the first end 18 of the barrel 12. The shaft 28 is extended through the bore 24 until its second end 34 projects from the second side 20. The spring 56 is next installed on the projecting portion of the shaft 28, and the shaft 28 brought into engagement with the hook 16 adjacent the second end 34.

Figure 17:
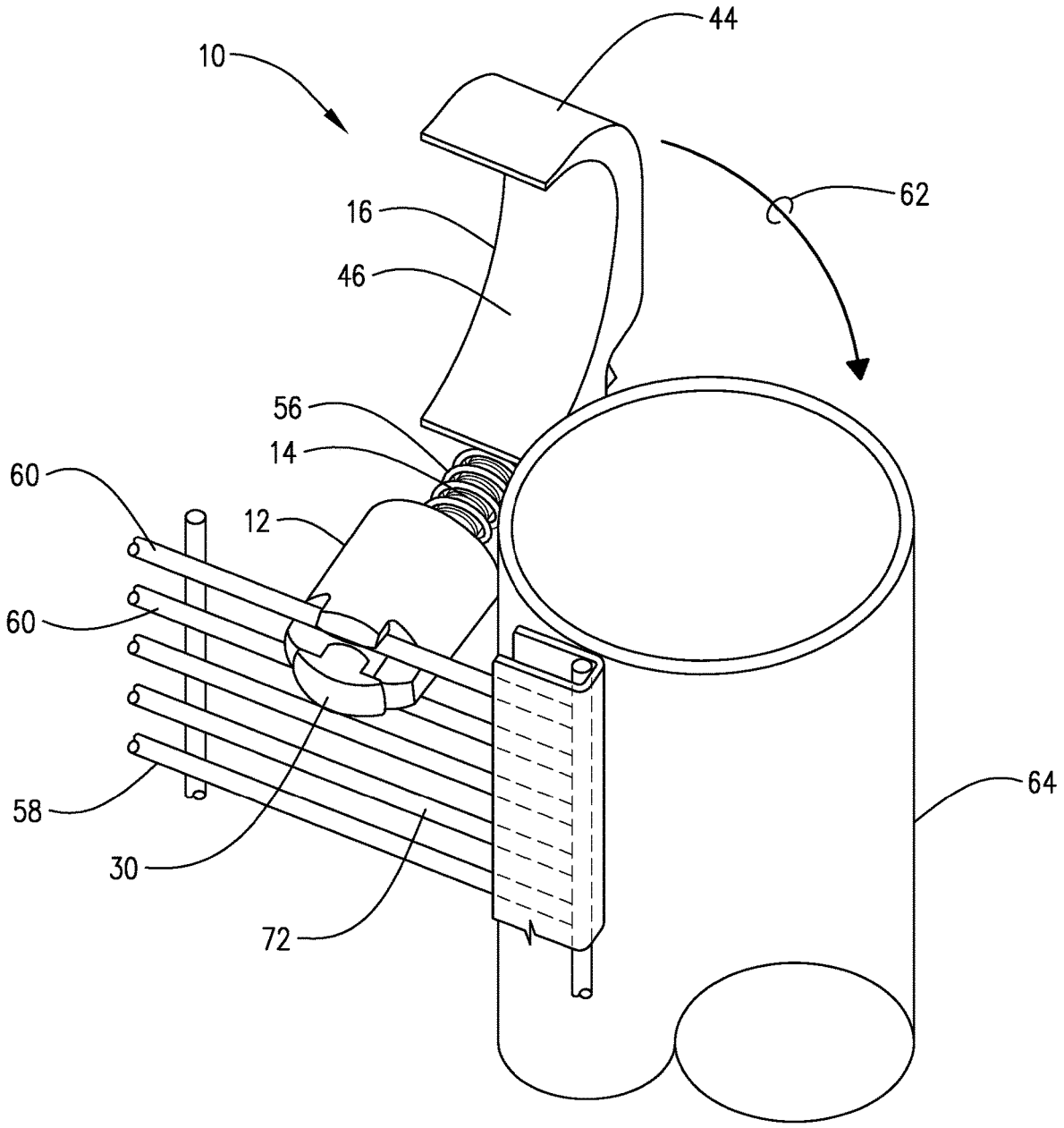
FIG. 17 is a perspective view showing an initial stage of assembly of the connector shown in FIG. 1 with a sheet of infill material and a post.

More particularly, the shaft 28 is inserted through the passageway 52 in the base 42 until the second end 34 projects from the first side 48. The pin 14 is rotated to its unactuated position, such that the channels 26 are unobstructed by the head 30. In this position, the hook 16 stands at a 12-o-clock position relative to the barrel 12, as shown in FIGS. 1 and 17.

The connector 10 is brought up to a sheet 58 of infill material having at least one pair of parallel strands 60. Preferably, the spacing of the channels 26 has been configured so as to equal the spacing of adjacent strands in the sheet 58 with which the connector 10 is to be used. With the pin 14 still in its unactuated position, the barrel 12 is positioned so that one strand 60 is seated within each of the parallel channels 26, as shown in FIG. 17.

Figure 18:
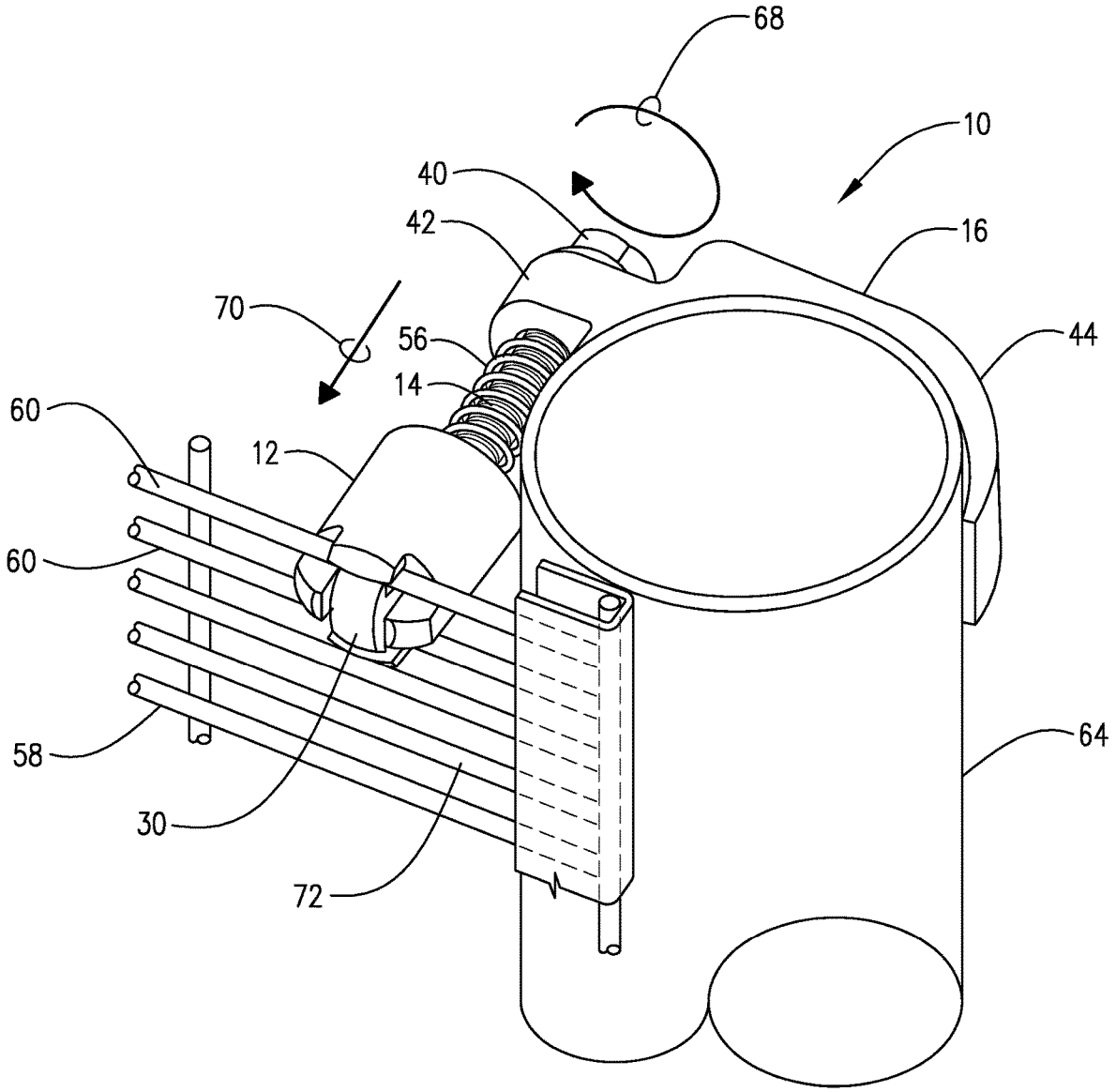
FIG. 18 is a perspective view showing a later stage of assembly of the connector shown in FIG. 1 with a sheet of infill material and a post.
Figure 11:
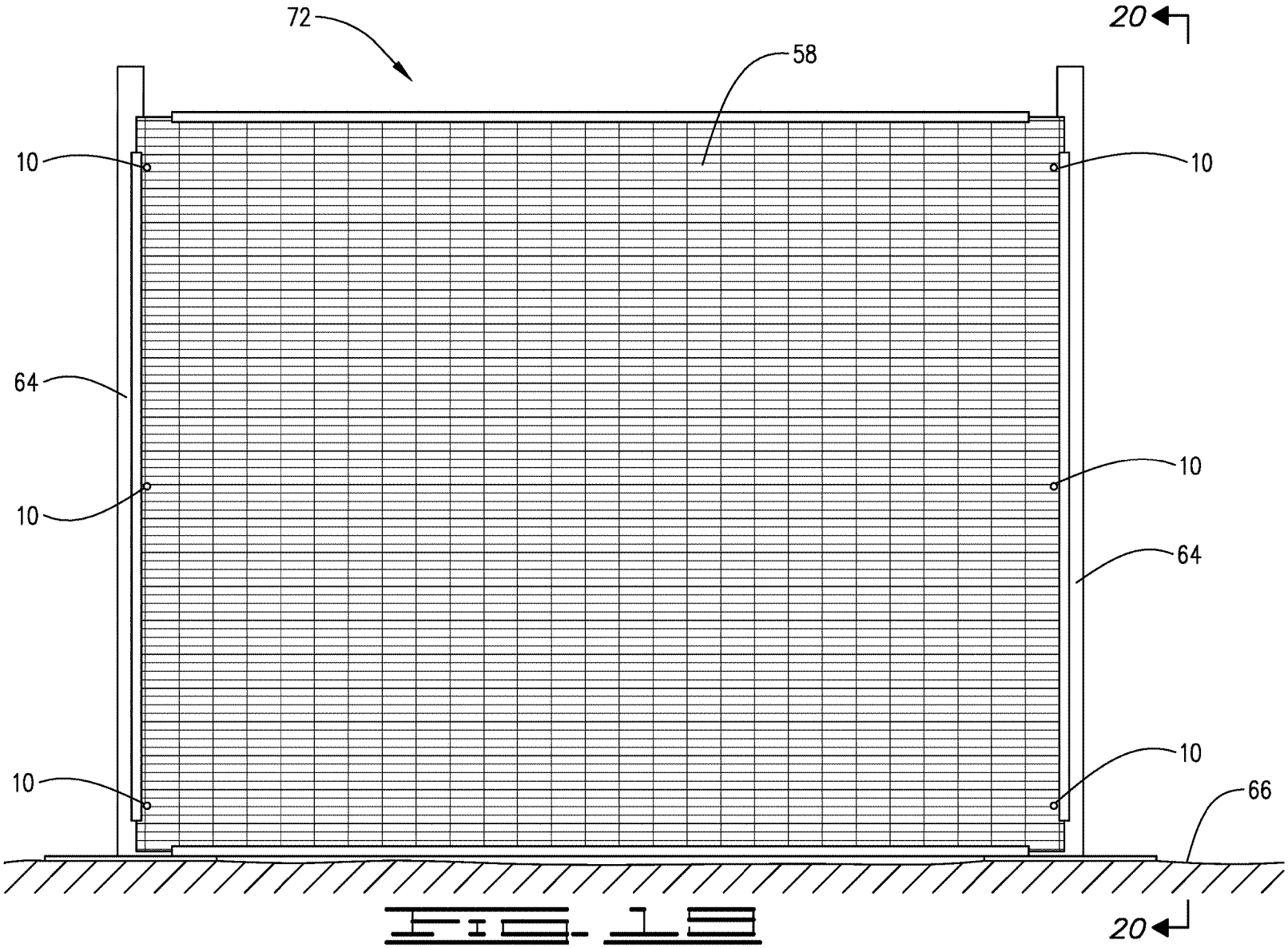

In order to actuate the connector 10, the hook 16 is rotated in the direction of arrow 62. The hook 16 moves through 90 degrees to the 3-o-clock position shown in FIGS. 2 and 18. Because the hook 16 and pin 14 rotate as a unit, the head 30 to rotates through a 90-degree angle as well. The rotated head 30 now blocks the channels 26, thereby securing the strands 60 within the connector 10.

As the hook 16 rotates, the spring 56 keeps the barrel 12 pressing against the strands 60, so that the strands 60 remain seated in their respective channels 26 until those channels are blacked by the head 30. This feature assists with single-handed installation of the connector 10.

Preferably, the connector 10 is used to join the sheet 58 to a vertical post 64 having one end that engages a terrain 66. Thus, the point at which the connector 10 is attached to the sheet 58 is chosen so that the hook 16 is within engagement reach of the post 64. When the hook 16 is rotated to the actuated position shown in FIG. 18, the concavity 46 becomes aligned with and faces the post 64.

The nut 40 is next actuated by threading it onto the second end 34, if necessary, and tightening it against the first side 48 by rotation in the direction of arrow 68. This tightening of nut 40 moves the hook 16 in the direction of arrow 70, and brings the body 44 of the hook 16 into solid engagement with the post 64.

The concavity 46 of the body 44 of the hook 16 is preferably configured to conform to the external shape of the post 64 with which the connector 10 is to be used. If the exterior cross-sectional profile of the post 64 is a circle or near-circle (such as a dodecagon), the contour of the concavity 46 is preferably a circular arc. Engagement with the post 64 at the edge of the second end 20 keeps the barrel 12 locked against the sheet 58.

Figure 20:
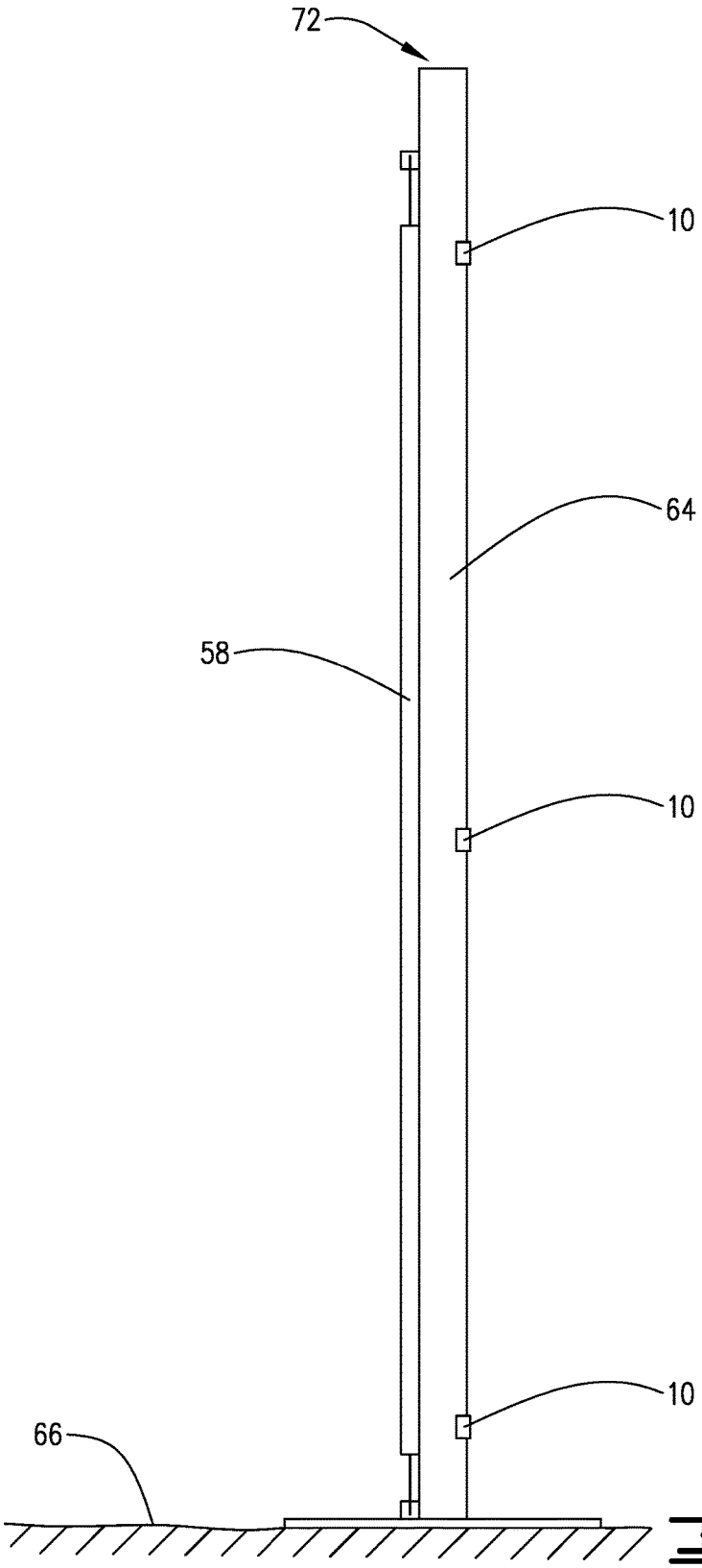
FIG. 20 is a side elevation view of the barrier shown in FIG. 19, taken along line 20-20.

Plural connectors 10 may be used to suspend a sheet 58 between a spaced pair of vertical posts 64 situated on a terrain 66, as shown in FIGS. 19 and 20. The posts 64 and sheet 58 may comprise all or part of a barrier 72, such as a temporary fence. The terrain 66 may comprise the ground or some other substrate, such as a body of concrete.

One or more of the connectors 10 may be combined with one or more other components to form a kit. One such kit may comprise one or more of the connectors 10 and one or more of the sheets 58. Another such kit may comprise one or more of the connectors 10, one or more of the sheets 58 and one or more the posts 64.

Unless otherwise stated herein, any of the various parts, elements, steps and procedures that have been described should be regarded as optional, rather than as essential. Changes may be made in the construction, operation and arrangement of the various parts, elements, steps and procedures described herein without departing from the spirit and scope of the invention as described in the following claims.

The invention claimed is:

1. A connector, comprising:

a hollow barrel having a pair of parallel channels traversing one of its ends;

a pin rotatable between unactuated and actuated positions, comprising:

an elongate shaft having opposed first and second ends, the shaft extending through the barrel; and an enlarged head formed adjacent the first end of the shaft, the head configured to block the channels in the actuated position, and to clear the channels in the unactuated position; and a hook that engages the shaft adjacent the shaft's second end.

2. The connector of claim 1 in which the barrel is an elongate structure having a longitudinal axis, and in which the channels extend in normal relationship to that axis.

3. The connector of claim 1 in which the hook comprises:

a base; and a body supported by the base, the body having a concavity formed therein.

4. The connector of claim 3 in which a passageway extends through the base of the hook and in which the shaft extends through the passageway.

5. The connector of claim 4 in which the passageway has at least one flat surface, and in which the shaft has at least one laterally-disposed flat surface engagable with the flat surface of the passageway.

6. The connector of claim 1 in which the pin and hook are not relatively rotatable.

7. The connector of claim 1 in which the barrel is an elongate structure having a longitudinal axis, the pin and the hook being rotatable as a unit around that longitudinal axis.

8. The connector of claim 1 in which the barrel has the external shape of a right conical frustum.

9. The connector of claim 1 in which the barrel is an elongate hollow structure having a first end and an opposed second end, the said ends being joined by an internal bore.

10. A kit, comprising:

the connector of claim 1; and a sheet of infill material having a pair of parallel strands seatable within respective channels of the barrel.

11. The kit of claim 10, further comprising:

an elongate post having an external shape which the hook is configured to conform to.

12. A barrier situated on a terrain, comprising:

the kit of claim 11 in which one end of the post engages the terrain and in which the connector joins the sheet of infill material to the post.

13. A connector, comprising:

a hollow barrel having a pair of parallel channels traversing one of its ends;

a pin rotatable between unactuated and actuated positions, comprising:

an elongate shaft having opposed first and second ends, the shaft extending through the barrel; and an enlarged head formed adjacent the first end of the shaft, the head configured to block the channels in the actuated position, and to clear the channels in the unactuated position;

a hook that engages the shaft adjacent the shaft's second end; and a coiled spring through which the shaft extends, the spring interposed between the barrel and the hook.

* * * * *